US005166028A

United States Patent [19]

Paine et al.

[11] Patent Number: 5,166,028

[45] Date of Patent: Nov. 24, 1992

[54] PROCESSES FOR THE PREPARATION OF STYRENE BUTADIENE RESINS

[75] Inventors: Anthony J. Paine, Mississauga; Michael K. Georges, Guelph, both of Canada

[73] Assignee: Xerox Corporation, Stamford, Conn.

[21] Appl. No.: 304,160

[22] Filed: Jan. 31, 1989

[51] Int. Cl.[5] ..... G03G 9/00

[52] U.S. Cl. ..... 430/109; 430/111; 430/904

[58] Field of Search ..... 430/109, 904, 111

[56] References Cited

U.S. PATENT DOCUMENTS

| | | | |
|---|---|---|---|
| 3,346,520 | 10/1967 | Lee | 260/17 |
| 3,560,418 | 2/1971 | Kelley et al. | 260/17 |
| 3,941,729 | 3/1976 | Klein | 260/17 A |
| 4,298,672 | 11/1981 | Lu | 430/108 |
| 4,338,390 | 7/1982 | Lu | 430/106 |
| 4,345,056 | 8/1982 | Thyret et al. | 526/200 |
| 4,524,199 | 6/1985 | Lok et al. | 430/114 |
| 4,558,108 | 12/1985 | Alexandra et al. | 526/340 |
| 4,607,058 | 8/1986 | Hong | 521/56 |
| 4,665,002 | 5/1987 | Dan et al. | 430/114 |
| 4,739,023 | 4/1988 | Lee et al. | 526/194 |
| 4,777,104 | 10/1988 | Matsumoto et al. | 430/111 |
| 4,963,455 | 10/1990 | Laing et al. | 430/106.6 |

*Primary Examiner*—Marion E. McCamish
*Assistant Examiner*—Steve Crossan
*Attorney, Agent, or Firm*—E. O. Palazzo

[57] ABSTRACT

A dispersion polymerization process for the preparation of styrene butadiene polymers with an average particle diameter of from about 0.1 to about 200 microns, which comprises (1) formation of a homogenous reaction medium, containing styrene and butadiene monomers in the presence of a steric stabilizer and a chain propagating amount of an initiator; and (2) heating said homogeneous reaction medium under pressure permitting polymerization thereby resulting in the formation of insoluble styrene butadiene polymer particles.

14 Claims, No Drawings

PROCESSES FOR THE PREPARATION OF STYRENE BUTADIENE RESINS

BACKGROUND OF THE INVENTION

This invention is generally directed to processes for the preparation of styrene butadiene resins. More specifically, the present invention is directed to processes for the preparation of styrene butadiene resins by dispersion polymerization methods. In one embodiment of the present invention, there is provided a process for the preparation of styrene butadiene copolymer resins by the polymerization of styrene and butadiene monomers in the presence of a steric stabilizer, wherein the stabilizer and monomers are soluble, and the copolymer formed is insoluble in the reaction medium. There is thus enabled with the process of the present invention styrene butadiene polymers which are useful as toner resins, and which resins need not be jetted. Some advantages of the process of the present invention include, for example, enablement of the direct preparation of toner size particles, that is those with an average diameter of from about 1 to about 15 microns, and preferably from about 3 to about 10 microns; narrow particle size distributions, that is with geometric standard deviations, GSD, of from about 1.0 to 1.4, and especially those with GSD of from about 1.0 to 1.1; broader molecular weight distributions in the polymer resulting in improved fusing properties; improved ability to initiate process changes enabling modification of the polymer properties for specific requirements; the avoidance of suspension failure; and the other advantages indicated herein.

The styrene butadiene polymers obtained with the processes of the present invention can be selected as resins for toner compositions, including magnetic, single component, two component, and colored toner compositions. There are also provided in accordance with the present invention positively or negatively charged toner compositions comprised of styrene butadiene resin particles obtained by the dispersion polymerization processes illustrated herein, pigment particles or dyes, and optional additive components such as metal salts of fatty acids, colloidal silicas, waxes with hydroxyl functionality, and charge enhancing additives. The toner, and developer compositions illustrated herein are useful in electrophotographic imaging systems, especially xerographic imaging methods. In addition, developer compositions comprised of the aforementioned toners and carrier particles can be formulated.

Copolymers of styrene and butadiene may be prepared by various techniques, reference U.S. Pat. No. 4,469,770. Emulsion polymerization is believed to be the most popular polymerization process selected for the preparation of the aforementioned copolymers. However, emulsion polymerization processes have a number of disadvantages, including for example the presence of undesirable residual contaminants in the emulsion polymerization process. For example, the presence of ionic surfactants, such as sodium dodecylbenzene sulfonate, during emulsion polymerization may adversely affect the electrical properties of electrostatic toners prepared with these materials. In addition, emulsion polymerization techniques generate particle sizes (average particle diameter), usually less than one micron, which particles are of insufficient size to permit their direct utilization as toner compositions.

Suspension polymerization processes may also be selected to prepare copolymers of styrene and butadiene. For example, U.S. Pat. No. 4,558,108 discloses a suspension stabilizing agent such as tricalcium phosphate to prevent particle agglomeration. However, the aforesaid polymerization processes are susceptible to suspension failure. With failed batches, the poorly suspended particles coalesce into a single lump of polymer, leading to bulk polymerization. This adversely affects heat transfer, molecular weight and monomer conversion resulting in materials that are unsuitable as toner resins. In suspension polymerization, the surfactant to water ratio, tricalcium phosphate to monomer ratio, source and purity of tricalcium phosphate, and the presence of other additives such as chain transfer agent or crosslinking agent are of importance to suspension stability. In addition, stirring too slow or too fast can also cause suspension failure. The present invention avoids the need for formation of a suspension thereby eliminating the danger of suspension failure. A further advantage of the process of the present invention is the ability to synthesize toner sized particles, whereas with suspension polymerization processes there are usually generated particles of an average diameter of from about 200 to about 2,000 nanometers. Another advantage associated with the process of the present invention resides in the ability to synthesize monodispersed particles, that is those with a very narrow size distribution possessing, for example, a GSD of from about 1.0 to 1.1. Such a narrow size distribution is advantageous since all the particles are substantially the same size, therefore, there are substantially no particles significantly larger or smaller than the average size, whose preferential development can cause with usage modifications in the toner triboelectric characteristics and the developed density.

In Hong U.S. Pat. No. 4,607,058, there is disclosed vinyl or ethylenic polymerization in the presence of a dispersant, preferably a hydroxypropylmethylcellulose polymer with a molecular weight of 50,000 to 500,000, in an aqueous vehicle. This patent disclosed refers to suspension polymerization processes, that is the monomer selected is insoluble in the solvent (water). In contrast, the process of the present invention is directed to dispersion polymerization, that is where the monomer or monomers are soluble in the reaction medium. Further, the monomer of the '058 patent is usually present in the form of droplets, which causes suspension failure, while with the process of the present invention the monomer or monomers are molecularly dissolved in the solvent. Furthermore, the '058 patent process appears to occur in water only. Moreover, the process of the '058 patent generally yields particles with a size of 30 to 1,000 microns (typically 120 microns), while with the process of the present invention there are usually provided smaller particles, that is with an average diameter of from about 0.1 to about 200 microns particles, and typically from about 5 to about 10 microns, which are of more interest to us. The difference in size range results, it is believed, since the size of the particles of the '058 patent are determined by the droplet size, while with the process of the present invention, particle size is usually dependant upon the solvent selected, the concentration and molecular weight of the steric stabilizer, monomer concentration, the dynamics of the reaction-/agglomeration of the polymer, and other factors. Additionally, with the process of the present invention grafting and steric stabilization are permitted. The term dispersion is utilized in the aforesaid '058 patent with reference to the initial monomer water mixture, reference column 1, line 10, however, such a reference is not directed to, it is believed, dispersion polymerization as illustrated with reference to the process of the present invention. Also, the term dispersion, for example, has been applied to multiphase mixtures such as those employed in suspension polymerization. Other patents of interest include U.S. Pat. Nos. 3,346,520; 3,560,418; 3,941,729; 4,345,056 and 4,739,023.

Developer and toner compositions with certain waxes therein are known. For example, there are disclosed in U.K. Patent Publication 1,442,835 toner compositions containing resin particles, and polyalkylene compounds, such as polyethylene and polypropylene of a molecular weight of from about 1,500 to 6,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. In addition, many patents disclose the use of metal salts of fatty acids for incorporation into toner compositions, such as U.S. Pat. No. 3,655,374, the disclosure of which is totally incorporated herein by reference. Also, it is known that the aforementioned toner compositions with metal salts of fatty acids can be selected for electrostatic imaging methods wherein blade cleaning of the photoreceptor is accomplished, reference Palmeriti et al. U.S. Pat. No. 3,635,704, the disclosure of which is totally incorporated herein by reference. Additionally, there are illustrated in U.S. Pat. No. 3,983,045 three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms; or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43. Toner and developer compositions with styrene butadiene polymers are also disclosed in application U.S. Ser. No. 081,261, (now abandoned) the disclosure of which is totally incorporated herein by reference.

Illustrated in U.S. Pat. No. 4,883,736, the disclosure of which is totally incorporated herein by reference, are toner and developer compositions with linear polymeric alcohols comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation, and wherein the toner may contain styrene butadiene resins. Particularly preferred polymeric alcohols include those wherein n represents a number of from about 30 to about 50. Therefore, the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions in various effective amounts, and can be added as uniformly dispersed internal, or as finely divided uniformly dispersed external additives. More specifically, the polymeric alcohols are present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there are added thereto finely divided polymeric alcohols. The aforementioned alcohols can also be selected as optional additives for toner compositions containing the styrene butadiene resins obtained by the processes of the present invention.

Furthermore, references of background interest are U.S. Pat. Nos. 3,165,420; 3,236,776; 4,145,300; 4,271,249; 4,556,624; 4,557,991; and 4,604,338.

Moreover, toner and developer compositions containing charge enhancing additives, especially additives which impart a positive charge to the toner resin, are well know. Thus, for example, there is described in U.S. Pat. No. 3,893,935 the use of certain quaternary ammonium salts as charge control agents for electrostatic toner compositions. There is also described in U.S. Pat. No. 2,986,521 reversal developer compositions comprised of toner resin particles coated with finely divided colloidal silica. According to the disclosure of this patent, the development of images on negatively charged surfaces is accomplished by applying a developer composition having a positively charged triboelectric relationship with respect to the colloidal silica. Further, there are illustrated in U.S. Pat. No. 4,338,390, the disclosure of which is totally incorporated herein by reference, developer and toner compositions having incorporated therein as charge enhancing additives, organic sulfate and sulfonate compositions; and in U.S. Pat. No. 4,298,672, the disclosure of which is totally incorporated herein by reference, positively charged toner compositions containing resin particles and pigment particles, and as a charge enhancing additive alkyl pyridinium compounds, inclusive of cetyl pyridinium chloride.

Other prior art disclosing positively charged toner compositions with charge enhancing additives include U.S. Pat. Nos. 3,944,493; 4,007,293; 4,079,014; and 4,394,430.

SUMMARY OF THE INVENTION

It is an object of the present invention to provide processes for the preparation of styrene butadiene resins with many of the advantages illustrated herein.

Another object of the present invention is to provide dispersion polymerization processes for the preparation of styrene butadiene resins without suspension failure.

Another object of the present invention resides in processes for the preparation of styrene butadiene polymers by dispersion polymerization.

In another object of the present invention there are provided styrene butadiene polymers of toner particle size, that is for example an average particle diameter of from about 1 to about 15 microns.

In yet another object of the present invention there are provided colored styrene butadiene polymer particles of toner particle size of from about 1 to about 15 microns.

In another object of the present invention there are provided monodisperse particles with low fine particle content, and small toner size of from about 3 to about 10 microns, which are in many instances preferred for high resolution xerography.

Moreover, another object of the present invention relates to the provision of dispersion polymerization processes for the preparation of styrene butadienes with a broad range of molecular weights.

In another object of the present invention there are provided dispersion processes for the preparation of styrene butadiene polymers that need not be jetted prior to their incorporation into toner compositions.

Furthermore, in another object of the present invention there are provided positively or negatively charged toner and developer compositions useful for the development of images present on positively or negatively charged imaging members.

In yet another object of the present invention there are provided two component, single component toner compositions, and colored toner compositions with styrene butadienes containing the styrene butadiene polymers obtained by the dispersion process illustrated herein, which compositions contain certain treated waxes therein or thereon.

These and other objects of the present invention are accomplished by a dispersion polymerization process for the preparation of styrene butadiene polymers useful as resin particles for toner compositions. More specifically, the process of the present invention comprises the polymerization of a mixture of styrene and butadiene monomers in the presence of a steric stabilizer polymer in a reaction medium, and wherein the stabilizer and monomers are soluble, and the polymer formed is insoluble thereby enabling the formation of latex dispersions with particles containing an average diameter of from about 0.1 to about 200 microns. In one specific embodiment of the present invention the process comprises providing a homogeneous organic or aqueous/organic phase comprising at least one solvent, or mixtures thereof, at least one steric stabilizer, or mixtures thereof, a chain propagating amount of at least one initiator, or mixtures thereof, styrene monomer, butadiene monomer, and an optional surfactant; the ratio of the styrene monomer and butadiene monomer being between about 70:30 and about 95:5 by weight; the weight proportion of the combination of styrene monomer and butadiene monomer to solvent being between about 0.05:1 and about 1.2:1; the weight proportion of steric stabilizer to the combination of styrene monomer and butadiene monomer being between about 0.01:1 to about 1:1; the weight proportion of the initiators to the combination of the styrene and butadiene monomers being between about 0.1 percent to 7 percent; the optional amount of surfactant being present in an amount of from between about 0.01 percent and 20 percent by weight; and a vapor phase comprising an inert gas and butadiene monomer; and heating the organic phase and the vapor phase to a temperature between about 40° C. and about 130° C. at a pressure of between about 20 psi and about 2,000 psi for a period of between about 6 and about 70 hours. Useful solvent mixtures are comprised of, for example, from about 2 to about 15 miscible solvents in proportions of from about 0.5 percent to 99.5 percent of any one solvent. Examples of solvent mixtures include aqueous alcohols comprised of from about 0.5 part to about 60 parts of water together with from about 40 parts to about 99.5 parts of an aliphatic alcohol $C_nH_{2n+1}OH$, where n varies from about 1 to about 20; mixtures of aliphatic alcohols with different n values; mixtures of the aforementioned solvents with optional additional solvents including toluene, methylene chloride, dimethylacetamide, acetic acid, and the like. Useful mixtures of steric stabilizers can comprise, for example, from about 2 to about 10 steric stabilizers in proportions of from about 0.5 percent to 99.5 percent of any one stabilizer. Examples of mixtures of initiators comprise, for example, from about 2 to about 10 initiators, mixed in proportions of from about 0.5 percent to 99.5 percent of any one initiator.

Another embodiment of the present invention is directed to a dispersion polymerization process for the preparation of styrene butadiene polymers with an average particle diameter of from about 0.1 to about 200 microns which comprises (1) formation of a homogeneous reaction medium containing styrene and butadiene monomers in the presence of a steric stabilizer and a chain propagating amount of an initiator; and (2) heating said homogeneous reaction medium under pressure permitting polymerization and thereby resulting in the formation of insoluble styrene butadiene copolymer particles. Also, in another embodiment of the present invention there is provided a process for the preparation of styrene butadiene polymers with an average particle diameter of from about 0.1 to about 200 microns which comprises providing a homogeneous organic phase comprising at least one solvent, at least one steric stabilizer, a chain propagating amount of at least one initiator, styrene monomer, butadiene monomer, and a vapor phase comprising an inert gas and butadiene monomer; heating the organic phase and the vapor phase to a temperature of from about 40° to about 130° C. at a pressure of from about 20 to about 2,000 pounds per square inch thereby permitting polymerization; cooling the resulting mixture and separating therefrom the insoluble styrene butadiene copolymer product; and wherein the monomers and stabilizer are soluble in the reaction medium.

Various suitable styrene monomer or monomers, including polymerizable styrene derivatives may be employed in the polymerization process of the present invention. Typical polymerizable styrene derivatives include alpha methyl styrene, vinyl toluene, ethyl styrene, chlorostyrene, dichlorostyrene, alkoxy styrenes such as paramethoxystyrene, and the like. Styrene is preferred primarily because of its low cost and availability. The other monomeric reactant employed in the process of this invention is a butadiene, and preferably 1,3-butadiene. With styrene mixtures, from about 1 to about 99 percent of one monomer and from about 99 to about 1 percent by weight of a second identical or different monomer may be selected. Also, two or more monomer mixtures may be selected provided the objectives of the present invention are achievable. Similarly, butadiene mixtures, preferably two, can be selected.

The styrene monomer to butadiene monomer ratio may be of from about 5:95 to about 95:5 by weight. The preferred ratio of the styrene monomer to butadiene monomer reactants is between about 70:30 and about 95:5 by weight. Excessively low ratios of styrene monomer tend to cause a decrease of the glass transition temperature, Tg of the product, which may result in unacceptably low toner resin blocking temperatures and agglomeration of toner particles obtained from such resins. Unduly high ratios of styrene monomer can result in copolymer products with high softening temperatures and the formation of toners requiring high fixing temperatures and high fixing energies.

Illustrative examples of chain propagating components present in an effective amount include a free radical initiator soluble in the reaction medium. Typical free radical polymerization initiators include lauroyl peroxide, benzoyl peroxide, acetyl peroxide, decanoyl peroxide, azobisisobutyronitrile, t-butylperoxide, t-butylperbenzoate, t-butyl(ethylhexyl)monoperoxycarbonate, peroxydicarbonates, 2,2'-azobis(2,4-dimethyl-4-methoxyvaleronitrile), 2,2'-azobis(2,4'-dimethylvaleronitrile), and mixtures thereof. From, for example, about 0.1 percent to about 20 percent by weight of initiator to combined monomer or monomers may be selected, depending upon the initiator, reaction temperature, and the like. Too high a concentration of initiator can cause the formation of a low a molecular weight copolymer. Also, the reaction time may be excessive in some instances when initiator concentration is less than 0.1 percent of monomer.

Examples of suitable solvents and steric stabilizers are generally dependant upon each other and fall into two main classes. One class consists of aliphatic hydrocarbon or other nonpolar solvents with nonpolar steric stabilizers, while a second class consists of polar solvents and polar steric stabilizers. The weight proportion of the combination of styrene monomer and butadiene monomer to solvent may be between about 0.05:1 and about 1.2:1. The weight proportion of steric stabilizer to the combination of styrene monomer and butadiene monomer may be between about 0.01:1 to about 1:1.

Illustrative examples of solvents employed in the nonpolar first class include aliphatic hydrocarbons $C_nH_{2n+2}$, where n varies from about 4 to about 30, carbon tetrachloride, and the like, as well as mixtures thereof. Compatible steric stabilizers for these solvents include poly(12-hydroxystearic acid), poly(isobutylene), poly(isoprene), poly(2-ethylhexylmethacrylate), copolymers thereof, block copolymers, including Kraton styrene and isoprene copolymers available from Shell Company, and the like.

Examples of polar second class solvents include linear and branched aliphatic alcohols $C_nH_{2n+1}OH$, where n varies from about 1 to about 20, cyclohexanol, 2-methoxyethanol, 2-ethoxyethanol, acetic acid, propanoic acid, and the like, optionally mixed with water, or other organic solvents, including other aliphatic alcohols, toluene, methylene chloride, chloroform, N,N-dimethylacetamide, N,N-dimethylformamide, formamide, benzene, xylene, tetrahydrofuran, 1,4-dioxane, and the like, provided the initial mixture of styrene monomer, butadiene monomer, steric stabilizer polymer and solvent is homogeneous, and providing that the styrene butadiene polymer formed in the reaction is insoluble in the reaction mixture, or reaction medium comprised of solvents and monomers. Compatible steric stabilizer polymers for these polar second class solvents include soluble cellulose derivatives such as hydroxypropyl cellulose and methyl cellulose, poly(vinyl pyrrolidone), poly(vinyl butyral), poly(ethylene oxide), poly(acrylic acids), poly(vinyl pyridine), and the like.

The amount of solvent selected for process of the present invention, and specifically for the polymerization process may be varied, however a weight ratio of combined styrene monomer and butadiene monomer to solvent is preferably between about 0.01:1and about 2:1. When the monomer concentration is below 0.01:1, the reaction is very dilute and usually not considered economical. Monomer concentrations above 2:1 by weight may result in reactions with poor heat transfer, which are difficult to stir, and may not form particles. In general, the particle size increases as the concentration of monomers increases.

The amount of steric stabilizer added to the reaction mixture may be varied between about 1 and 100 percent by weight, and preferably between about 3 and 30 percent by weight of the combined styrene and butadiene monomer. Lower concentrations of steric stabilizer may cause the particle copolymer products to coalescence. Higher amounts of steric stabilizer may be insoluble in the reaction medium, and render the mixture too viscous for effective stirring or mixing.

While not being limited by theory, it is believed that during the dispersion polymerization of styrene and butadiene, radical sites are created on the steric stabilizer polymer backbone which polymerize a small amount of the styrene and butadiene present onto the steric stabilizer molecule creating a graft copolymer which precipitates onto the surface of growing styrene butadiene resin particles and provides stabilization against coalescence via a steric barrier. The preferred properties of this graft copolymer include the soluble part originating from the initially added steric stabilizer freely dissolved in solution, while the insoluble styrene butadiene copolymer part which is insoluble precipitates on the particle surface. To achieve this property, it is preferred that the relative molecular weights of the styrene butadiene fragment and the steric stabilizer fragment on the graft copolymer be of similar magnitude, that is, in a ratio of from about 10:1 to about 1:10 to obtain toner sized styrene butadiene particles.

Illustrative examples of optional surfactants which may be added to the polymerization reaction mixture include neutral, anionic, cationic, and ambiphilic surfactants, such as nonylphenyl poly(ethylene oxides), stearates, sulfosuccinates, quaternary ammonium salts, and the like. While not being desired to be limited by theory, these added materials can sometimes increase the particle size or narrow the particle size distribution. For example, in a specific reaction accomplished in the absence of surfactant, a poly(vinyl pyrrolidone) stabilized polymerization of styrene yielded 8.5 micron average particle diameter particles with a GSD of 1.45, whereas polymerization in the presence of 1.8 percent Triton N-57 neutral surfactant provided polymer particles which were 8.5 microns with a GSD of 1.20. The amount of optional surfactant may be varied between about 0.01 and 20 percent of the total reaction weight.

Optionally, a crosslinking agent such as divinyl benzene may be added in an amount of 0.05 to 7 percent by weight compared to the combined styrene and butadiene amount as illustrated in U.S. Pat. No. 4,617,249, the disclosure of which is totally incorporated herein by reference. Amounts greater than 7 percent usually generate a high melting polymer with poor fusing properties.

The reaction process of the present invention can be conducted by known means including the use of a closed pressure vessel under an inert atmosphere such as nitrogen, argon and the like, to for example avoid loss of gaseous butadiene. Pressures of between about 20 psi and about 2,000 psi are usually selected to drive the monomers into the reactor against back pressure of flashed butadiene.

Agitation of the reaction mixture during heating is highly desirable to avoid agglomeration of the dispersed styrene butadiene copolymer particles and to disperse the heat of reaction. Various suitable conventional agitation techniques may be utilized, including mechanical stirring blades, magnetic mixers, ultrasonic agitations, homogenizers, shaking agitation, and the like.

The polymerization temperature will be dependent to some extent upon the half life of the free radical polymerization initiator and the weight ratio of combined monomers to solvent. Generally, a temperature between about 40° C. and about 130° C. is satisfactory. Temperatures below 40° generally cause longer reaction times. Temperatures above 130° can effect the macromolecular structure and the molecular properties of the product. The double bonds present in the copolymer at high reaction temperatures can induce or accelerate undesirable branching, crosslinking, and the like. The temperature may be maintained at a constant value throughout the reaction, or optionally increased to complete the reaction with a higher temperature initiator in situations where two initiators are selected.

The reaction time is dependent on a number of factors, including the reaction temperature; generally, however, the reaction time is from about 6 to about 70 hours. Reaction times outside the aforesaid ranges may be selected depending on, for example, the quantity of monomers and initiators, the temperature employed, and the like. Reaction times less than about 6 hours usually provide poor conversion, while times longer than 70 hours may be considered uneconomical in some instances.

It is further believed that significant reductions to 0.1 percent of the residual butadiene monomer in the final reaction product may be achieved by a venting process similar to that illustrated in U.S. Pat. No. 4,558,108, column 6, line 15, to column 8, line 14, the disclosure of which is incorporated herein by reference.

The molecular weight dispersity for the copolymer products obtained by the process of the present invention is defined as the ratio of weight average molecular weight divided by number average molecular weight, $M_w/M_n$. It is believed that wide molecular weight dispersities of greater than 3.5, for example from about 3.5 to 120, are most acceptable, and molecular weight dispersities of greater than 5, for example from 5 to 120, are particularly effective to prevent offset development wherein a part of the toner constituting an image is transferred to the surface of a heat roller at the time of the fixing operation and the partially transferred toner is transferred again to the next transfer paper, or the like, thereby soiling the paper. Furthermore, a wide molecular weight distribution is believed to be desirable for electrophotographic toners because of the dual importance of both lower fusing energy, which is aided by low molecular weight polymer, and increased viscoelasticity, which increases the fusing latitude, that is the difference between minimum fusing temperature and offset temperature, and which is aided by high molecular weight polymer. Therefore, it is desirable to have a mixture of both low molecular weight and high molecular weight polymer in the same toner resin, and this can be accomplished with a polymer possessing wide molecular weight distribution.

The process of the present invention permits, for example, styrene butadiene copolymers with wide molecular weight distributions, it is believed, because the locus of polymerization changes between being mainly inside the particle in the situation of smaller particles, to being mainly in solution in the situation with large particles. When the final particles are smaller, there are more growing particles, and they readily capture growing oligomeric radicals from solution by a mechanism similar to emulsion polymerization, which captured radicals then continue to polymerize inside the growing particle. Such polymerization inside the particle is well known to lead to high molecular weight polymer due to the increased viscosity, which decreases the termination rate constant. Therefore, the polymer formed inside the particles has much higher molecular weight than the polymer formed in solution. When the final particles are larger, there are generally fewer of them, and they are usually unable to scavenge the oligomeric radicals before the radicals terminated in solution. In this situation, the dead polymer was collected by the larger particles, and is generally of much lower molecular weight, usually that of the solution polymerization. With substantially all particles obtained with the process of the present invention and particularly medium sized final particles, the combination of polymer formed in solution with that formed inside the particles leads to wide molecular weight distributions.

Greater molecular weight dispersity of the final copolymer may be achieved by introducing an additional mixture of styrene monomer, butadiene monomer, initiator, and optional additional steric stabilizer to the reaction mixture, or reaction medium at least once during the heating step, or by introducing a chain transfer agent to moderate the molecular weight. For example, with styrene dispersion polymerization in the presence of a butanethiol as chain transfer agent, molecular weight dispersities of from about 50 to 120 can be obtained. The very wide molecular weight distributions obtained resulted, it is believed, from the chain transfer agent distributing itself in both the solvent and particle phases, and having a substantial effect in each phase. In view of the above, it is further believed that comparable molecular weight distributions in dispersion polymerized styrene butadiene resins could be achieved by addition of the same or other chain transfer agent. The aforementioned addition of chain transfer agent, which might cause suspension failure in the case of suspension polymerization processes, poses no particular problems to the dispersion polymerization process of the present invention. A particular advantage of the process of the present invention is the absence of a suspension, thus a suspending agent is avoided, and suspension failure does not occur. Instead, a sterically stabilized dispersion is formed in the reaction solvent, wherein particle coalescence is prevented by the grafted steric stabilizer on the particle surfaces. Also, with many of the the prior art processes of emulsion polymerization, the final particle size is usually smaller than one micron, the molecular weight greater than 500,000, and the molecular weight dispersity less than 4. With the process of a single heating stage suspension polymerization, the final particle size is usually greater than 100 microns, and the molecular weight dispersity between about 2 and about 5. However, with the process of the present invention, particles of from about 1 to 15 microns may be prepared, with weight average molecular weight of from about 10,000 to about 500,000, and molecular weight dispersity of from about 3 to about 100.

The resulting styrene butadiene polymers can be selected as toner resins for toner and developer compositions containing pigment particles and optional additive components. One toner composition embodiment encompasses dyeing or pigmenting the styrene butadiene product obtained by the process illustrated herein by various suitable known methods, and selecting them directly as toner size particles in toners or developers without jetting. Another embodiment encompasses the well known art of melt blending and jetting the appropriate components to prepare toner size particles.

More specifically, toner size particles of from about 1 to about 15 microns can be optionally treated with alkyl halides or alcohols or carboxylic acids to chemically modify the surface groups and thereby change the triboelectric charging level to about 5 to 50 microcoulombs per gram as illustrated in U.S. Pat. No. 4,652,508, the disclosure of which is totally incorporated herein by reference. Such particles may then be colored by a variety of methods, including those described in Examples VIII to X hereinafter, or by adding the pigment or dye together with the reactants at the initation of the polymerization (the in situ method), or by the method described in U.S. Pat. No. 4,613,559, the disclosure of which is totally incorporated herein by reference, or by any other suitable method. These methods are suitable for toners prepared from the colored resin by melt blending, however, the presence of the colorant, pigment or dye during polymerization in the in situ method usually changes the size and size dispersity of the particles obtained from the reaction when compared to unpigmented particles obtained under similar conditions. Therefore, the in situ method is usually not preferred for the aforesaid first main embodiment.

In another embodiment of the present invention, the resulting styrene butadiene polymer can be selected as toner resins for melt blending and jetting into toners for toner and developer compositions containing pigment particles, and optional additive components. It is believed that an electrostatographic toner can be prepared by melt blending in a Banbury mixing device maintained at 100° to 140°, followed by mechanical attrition, comprised of from about 70 to 97 percent by weight of the styrene butadiene resin provided by the process of the present invention, 3 to 15 percent by weight of colored dye or pigment particles, or carbon black, 0.1 to 20 percent of charge enhancing additive, and an optional amount of 1 to 7 percent by weight of a suitable wax, linear alcohol, or other additive.

Developer compositions comprised of the aforementioned toners and carrier particles can also be prepared. Therefore, the developer compositions are comprised of toner compositions containing styrene butadiene polymers obtained by the process illustrated herein, pigment particles such as cyan, magenta, yellow, red, green, brown; magnetites, carbon blacks or mixtures thereof, and optional additives such as charge control components, particularly for example distearyl dimethyl ammonium methyl sulfate, reference U.S. Pat. No. 4,560,635, the disclosure of which is totally incorporated herein by reference; metal salts of fatty acids, silica particles, polymeric hydroxy waxes available from Petrolite as detailed hereinafter, which waxes can be incorporated into the toner compositions, and carrier particles. As preferred carrier components for the aforementioned compositions, there are selected steel or ferrite materials, particularly with a polymeric coating thereover including the coatings as illustrated in U.S. Ser. No. 751,922, (now abandoned) U.S. Pat. Nos. 4,935,326 and 4,937,106, the disclosures of which are totally incorporated herein by reference. One particularly preferred coating illustrated in the aforementioned patents and applications is comprised of a copolymer of vinyl chloride and trifluorochloroethylene with conductive substances dispersed in the polymeric coating inclusive of, for example, carbon black. One embodiment disclosed in the aforementioned patents and applications is a developer composition comprised of styrene butadiene copolymer resin particles, and charge enhancing additives selected from the group consisting of alkyl pyridinium halides, ammonium sulfates, and organic sulfate or sulfonate compositions; and carrier particles comprised of a core with a coating of vinyl copolymers or vinyl homopolymers.

Illustrative examples of suitable toner resins selected for the toner and developer compositions illustrated herein and present in various effective amounts such as, for example, from about 70 percent by weight to about 95 percent by weight, include the styrene butadiene polymers obtained by the process of the present invention, inclusive of those with a weight average molecular weight of from about 10,000 to about 500,000, a molecular weight dispersity greater than 3 and preferably greater than 5, a ratio of styrene to butadiene of from about 70 to about 95 percent of styrene, and from about 5 to about 30 percent of butadiene, and preferably from about 80 to about 95 percent of styrene, and from about 5 to about 20 percent of butadiene.

Numerous well known suitable pigments can be selected as the colorant for the toner particles including, for example, carbon black, nigrosine dye, aniline blue, phthalocyanine derivatives, magnetites and mixtures thereof. The pigment, which is preferably carbon black, should be present in a sufficient amount to render the toner composition colored thereby permitting the formation of a clearly visible image. Generally, the pigment particles are present in amounts of from about 3 percent by weight to about 20 percent by weight based on the total weight of the toner composition, however, lesser or greater amounts of pigment particles can be selected providing the objectives of the present invention are achieved.

When the pigment particles are comprised of magnetities, including those commercially available as Mapico Black, they are present in the toner composition in an amount of from about 10 percent by weight to about 70 percent by weight, and preferably in an amount of from about 10 percent by weight to about 35 percent by weight. Alternatively, there can be selected as pigment particles mixtures of carbon black or equivalent pigments and magnetites, which mixtures, for example, contain from about 6 percent to about 70 percent by weight of magnetite, and from about 2 percent to about 15 percent by weight of carbon black. Particularly preferred as pigments are magnetites as they enable, for example, images with no toner spots for extended time periods exceeding the development of 100,000 images, which corresponds to about 400,000 imaging cycles for a panel containing four imaging members.

Also embraced within the scope of the present invention are colored toner compositions containing as pigments or colorants magenta, cyan, and/or yellow particles, as well as mixtures thereof. More specifically, with regard to the generation of color images utilizing the toner and developer compositions described herein illustrative examples of magenta materials that may be selected include, for example, 2,9-dimethylsubstituted quinacridone and anthraquinone dye identified in the Color Index as CI 60710, CI Dispersed Red 15, a diazo dye identified in the Color Index as CI 26050, CI Solvent Red 10, Lithol Scarlet, Hostaperm, Fanal Pink D, and the like. Illustrative examples of cyan materials that may be used as pigments include copper tetra-4(octadecyl sulfonamido) phthalocyanine, X-copper phthalocyanine pigment listed in the Color Index as CI 74160, CI Pigment Blue, and Anthrathrene Blue identified in the Color Index as CI 69810, Special Blue X-2137, Sudan Blue, and the like; while illustrative examples of yellow pigments that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, red, blue, green, brown, Lithol Scarlet, and the like. These pigments are generally present in the toner composition in an amount of from about 2 weight percent to about 15 weight percent based on the weight of the toner resin particles.

Illustrative examples of optional charge enhancing additives present in various effective amounts, such as, for example, from about 0.1 to about 20 percent by weight, include alkyl pyridinium halides, such as cetyl pyridinium chlorides, reference U.S. Pat. No. 4,298,672, the disclosure of which is totally incorporated herein by reference; cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; and other known similar charge enhancing additives providing the objectives of the present invention are accomplished; and the like.

With further respect to the toner and developer compositions of the present invention, as optional additives there can be selected linear polymeric alcohol comprised of a fully saturated hydrocarbon backbone with at least about 80 percent of the polymeric chains terminated at one chain end with a hydroxyl group, which alcohol is represented by the following formula:

$$CH_3(CH_2)_nCH_2OH$$

wherein n is a number of from about 30 to about 300, and preferably of from about 30 to about 100, which alcohols are available from Petrolite Corporation. Particularly preferred polymeric alcohols include those wherein n represents a number of from about 30 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols are present in the toner and developer compositions illustrated herein in various effective amounts, and can be added as uniformly dispersed internal, or as finely divided uniformly dispersed external additives. More specifically, the polymeric alcohols are present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. In contrast, when the polymeric alcohols are present as external additives, the toner composition is initially formulated comprised of, for example, resin particles and pigment particles; and subsequently there is added thereto finely divided polymeric alcohols.

Although it is not desirable to be limited by theory, it is believed that the aforementioned linear polymeric alcohols possess very narrow molecular weight dispersity, that is the ratio of $M_w/M_n$ is equal to or less than about 1.1 in one preferred embodiment; and moreover, these alcohols possess high crystallinity with a density of about 0.985. By high crystallinity is meant that the linear polymeric alcohol molecular chains possess a high degree of molecular order in their solid state molecular structure; and also possess zero to very few defects in this ordered molecular structure, reference for example the text *Macromolecule Structure and Properties, Vol. 1, authored by Hans Georg Elias* (1984), particularly Chapter 5, pages 151 to 154.

Illustrative examples of specific carrier particles that can be selected for mixing with the toner compositions illustrated herein include those particles that are capable of triboelectrically obtaining a charge of opposite polarity to that of the toner particles. Accordingly, the carrier particles of the present invention can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of carrier particles that may be selected include granular zircon, steel, nickel, iron, ferrites, and the like. Additionally, there can be selected as carrier particles, especially for colored developers, such as cyan compositions, nickel berry carriers as disclosed in U.S. Pat. No. 3,847,604, which carriers are comprised of nodular carrier beads of nickel characterized by surfaces of reoccurring recesses and protrusions thereby providing particles with a relatively large external area. Preferred carrier particles selected for the present invention are comprised of a magnetic, such as steel, core with a polymeric coating thereover, several of which are illustrated, for example, in U.S. Ser. No. 751,922 (now abandoned). Relating to developer compositions with certain carrier particles, the disclosure of which is totally incorporated herein by reference. More specifically, there are illustrated in the aforementioned application carrier particles comprised of a core with a coating thereover of vinyl polymers, or vinyl homopolymers. Examples of specific carriers illustrated in the copending application, and particularly useful for the present invention are those comprised of a steel or ferrite core with a coating thereover of a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride; and trichlorofluoroethylene; and other known coatings. There can also be selected as carriers components comprised of a core with a double polymer coating thereover, reference U.S. Pat. Nos. 4,935,326 and 4,937,166, the disclosures of which are totally incorporated herein by reference. More specifically, there is detailed in this application a process for the preparation of carrier particles with substantially stable conductivity parameters which comprises (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles.

Also, while the diameter of the carrier particles can vary, generally they are of a diameter of from about 50 microns to about 1,000 microns, thus allowing these particles to possess sufficient density and inertia to avoid adherence to the electrostatic images during the development process. The carrier particles can be mixed with the toner particles in various suitable combinations, however, best results are obtained when about 1 to about 5 parts per toner to about 10 parts to about 200 parts by weight of carrier are mixed.

The toner compositions illustrated herein can be prepared by a number of known methods, including mechanical blending and melt blending the toner resin particles obtained with the process as illustrated herein, pigment particles or colorants, and optional additives followed by mechanical attrition. Other methods include those well known in the art such as spray drying, mechanical dispersion, melt dispersion, dispersion polymerization, and suspension polymerization. In one dispersion polymerization method, a solvent dispersion of the resin particles, the pigment particles, and the treated polymeric alcohols, are spray dried under controlled conditions to result in the desired product. With further respect to the present invention, the treated polymeric alcohols are preferably added as external additives, that is the toner compositions are first prepared, which compositions are comprised of, for example, resin particles and pigment particles; and subsequently there is added thereto the optional additive particles.

In addition, the toner and developer compositions illustrated herein may be selected for use in developing images in electrophotographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253; and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines and vanadyl phthalocyanines, while examples of charge transport layers include the aryl amines as disclosed in U.S. Pat. No. 4,265,990. Other photoresponsive devices useful in the present invention include 4-dimethylaminobenzylidene, 2-benzylidene-amino-carbazole; (2-nitro-benzylidene)-p-bromoaniline; 2,4-diphenyl-quazoline; 1,2,4-triazine; 1,5-diphenyl-3-methyl pyrazoline; 2-(4'-dimethyl-amino phenyl)-benzoaxzole; 3-aminocarbazole; hydrazone derivatives; polyvinyl carbazole-trinitrofluorenone charge transfer complex; and mixtures thereof. Moreover, there can be selected as photoconductors hydrogenated amorphous silicon; and as photogenerating pigments squaraines, perylenes; and the like.

Moreover, the toner and developer compositions of the present invention are particularly useful with electrophotographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone. In one embodiment, this is accomplished by bringing a transporting member, such as a development roller, and a tensioned deflected flexible imaging member into close proximity, that is a distance of from about 0.05 millimeter to about 1.5 millimeters, and preferably from about 0.4 millimeter to about 1.0 millimeter in the presence of a high electric field, and causing such members to move at relative speeds. There is illustrated in the aforementioned '970 patent an electrostatographic imaging apparatus comprised of an imaging means, a charging means, an exposure means, a development means, and a fixing means, the improvement residing in the development means comprising in operative relationship a tensioned deflected flexible imaging means; a transporting means; a development zone situated between the imaging means and the transporting means; the development zone containing therein electrically insulating magnetic carrier particles, means for causing the flexible imaging means to move at a speed of from about 5 centimeters/second to about 50 centimeters/-second, means for causing the transporting means to move at a speed of from about 6 centimeters/second to about 100 centimeters/second, the means for imaging and the means for transporting moving at different speeds; and the means for imaging and the means for transporting having a distance therebetween of from about 0.05 millimeter to about 1.5 millimeters.

Another developer composition of the present invention is comprised of a toner composition with styrene butadiene resin particles (91/9), about 16 percent by weight of magnetite, about 3 percent by weight of carbon black, and about 1.0 percent by weight of the charge enhancing additive distearyl dimethyl ammonium methyl sulfate. Preferred carrier particles include a steel core with a coating thereover of a polymer of, for example, a vinyl chloride/trichlorofluoroethylene copolymer available as FPC 461, which coating has dispersed therein carbon black particles.

The following examples are being submitted to further define various species of the present invention. These examples are intended to illustrate and not limit the scope of the present invention. Also, parts and percentages are by weight unless otherwise indicated. Compositions of the final copolymers were determined by proton nuclear magnetic resonance spectroscopy and/or were calculated from the initial amounts of styrene and butadiene selected; molecular weights were determined by gel permeation chromatography in tetrahydrofuran using polystyrene molecular weight standards from Pressure Chemical Company; and particle size and size distributions were determined with a 256 channel Coulter Multisizer and scanning electron microscope.

EXAMPLE I

A styrene butadiene copolymer product containing 11.5 weight percent butadiene with a weight average molecular weight of 280,000 and molecular weight dispersity of 16.9 comprised of monodisperse spherical particles of 3.5 micron volume average diameter with a geometric standard deviation (GSD) of 1.06 was prepared as follows:

A solution of ethanol, 80 milliliters, and 1-propanol, 80 milliliters, containing predissolved hydroxypropyl cellulose from Scientific Polymer Products of nominal molecular weight of 100,000, 2.80 grams, was added to a modified 300 milliliter Parr pressure reactor. The reactor was sealed and flushed with nitrogen gas. The reactor contents were stirred at about 300 rpm and heated to 78°, at which time a solution of styrene, 25 milliliters, 22.92 grams, benzoyl peroxide, 0.508 gram, and freshly distilled butadiene, 2.94 grams, was added, via a sparge tube, under a nitrogen gas pressure of 60 psi. The reaction was allowed to continue at 71.8° C. for 45 hours during which time the pressure decreased to 47 psi. The reactor was then cooled to 40° and the contents were washed out with methanol. The product was freeze dried after washing twice with methanol and then water. The yield was 79 percent.

To obtain a dry resin product, the above obtained styrene butadiene copolymer product was freeze dried by dispersing it in approximately 10 parts of water per part of resin, freezing in an isopropanol bath chilled to minus 60°, then attaching to a vacuum freeze dryer machine for 24 hours, permitting drying to a constant weight.

EXAMPLE II

A styrene butadiene copolymer product containing 6 weight percent butadiene with a weight average molecular weight 152,000 and molecular weight dispersity of 6.7 comprised of spherical particles of 7.1 micron volume average diameter with a GSD of 1.40 was prepared as follows:

Butadiene, 1.50 grams, was distilled into a 150 milliliter heavy wall glass bottle held at −20° containing styrene, 23.5 grams, azoisobutyronitrile, 250 milligrams, and poly(vinyl pyrrolidone), 1.50 grams, in ethanol, 75 milliliters. The bottle was capped securely and the contents allowed to warm to room temperature with gentle shaking. Polymerization was carried out for 24 hours in a shaker bath at 70.0°. When the reaction was completed, the bottle was removed from the bath, and the particles isolated by centrifugation, washed twice with methanol, 100 milliliters, then three times with water, 100 milliliters. Freeze drying afforded the above copolymer product (94/6), 19.5 grams, in 78 percent yield.

EXAMPLE III

A styrene butadiene copolymer product containing about 13 weight percent butadiene (87/13) with a weight average molecular weight 253,000 and molecular weight dispersity of 5.7 comprised of monodisperse spherical particles of 2.6 micron volume average diameter,, and a GSD of 1.04 was prepared as follows:

Butadiene, 1.95 grams was distilled into a 150 milliliter heavy wall glass bottle held at −20° containing styrene, 13.05 grams, azoisobutyronitrile, 75 milligrams, and poly(vinyl pyrrolidone), 1.50 grams, in ethanol, 85 milliliters. The bottle was capped securely and the contents allowed to warm to room temperature with gentle shaking. Polymerization was carried out for 24 hours in a shaker bath at 70.0°. When the reaction was completed, the bottle was removed from the bath and the product particles isolated by centrifugation, washed twice with methanol, 100 milliliters, then three times with water, 100 milliliters. Freeze drying by repeating the procedure of Example I afforded the above copolymer product, 13.35 grams, in 89 percent yield.

EXAMPLE IV

A styrene butadiene copolymer product containing 13 weight percent butadiene with a weight average molecular weight of 163,000 and a molecular weight dispersity 6.7 comprised of monodisperse spherical particles of 4.5 micron volume average diameter, and a GSD of 1.04 was prepared as follows:

Butadiene, 1.95 grams, was distilled into a 150 milliliter heavy wall glass bottle held at −20° containing styrene, 13.05 grams, azoisobutyronitrile, 151 milligrams, and poly(vinyl pyrrolidone), 1.50 grams, in ethanol, 85 milliliters. The bottle was capped securely and the contents allowed to warm to room temperature with gentle shaking. Polymerization was carried out for 24 hours in a shaker bath at 70.0°. When the reaction was completed, the bottle was removed from the bath and the particles isolated by centrifugation, washed twice with methanol, 100 milliliters, then three times with water, 100 milliliters. Freeze drying afforded the above copolymer product, 12.15 grams, in 81 percent yield.

EXAMPLE V

A styrene butadiene copolymer product containing 20 weight percent butadiene (80/20) with a weight average molecular weight of 26,700 and molecular weight dispersity of 3.5 comprised of spherical particles of 8 micron volume average diameter was prepared as follows:

Butadiene, 3.00 grams, was distilled into a 150 milliliter heavy wall glass bottle held at −20° containing styrene, 12.00 grams, azoisobutyronitrile, 299 milligrams, and poly(vinyl pyrrolidone), 1.50 grams, in ethanol, 85 milliliters. The bottle was capped securely and the contents allowed to warm to room temperature with gentle shaking. Polymerization was carried out for 24 hours in a shaker bath at 70.0°. When the reaction was completed, the bottle was removed from the bath and the particles isolated by centrifugation, washing twice with methanol, 100 milliliters, then three times with water, 100 milliliters. Freeze drying afforded the above copolymer product material.

EXAMPLE VI

A styrene butadiene copolymer product of approximately 15 weight percent of butadiene with weight average molecular weight of 67,400 and molecular weight dispersity of 3.9 comprised of spherical particles of 7.4 micron volume average diameter was prepared as follows:

Butadiene, 2.25 grams, was distilled into a 150 milliliter heavy wall glass bottle held at −20° containing styrene, 12.75 grams, azoisobutyronitrile, 151 milligrams, and poly(vinyl pyrrolidone), 1.50 grams, in pentanol, 85 milliliters. The bottle was capped securely and the contents allowed to warm to room temperature with gentle shaking. Polymerization was carried out for 24 hours in a shaker bath at 70.0°. When the reaction was completed, the bottle was removed from the bath, and the particles isolated by centrifugation, washed twice with methanol, 100 milliliters, then three times with water, 100 milliliters. Freeze drying afforded the above copolymer resin product, 13.10 grams, in 87 percent yield.

EXAMPLE VII

A styrene butadiene copolymer containing 12.5 weight percent butadiene with a weight average molecular weight of 98,500 and a molecular weight dispersity of 8.0 comprised of spherical particles of 3.5 micron volume average diameter was prepared as follows:

A 1 liter Parr pressure reactor was charged with ethanol, 611 milliliters, styrene, 75 milliliters (68.2 grams), and poly(vinyl pyrrolidone), 10.78 grams, and sealed, with stirring at 70°. A metal sample cylinder was charged with styrene, 25.6 grams, and azoisobutyronitrile, 1.08 grams. Butadiene, 14.37 grams, was distilled into the sample cylinder held at −20°. The cylinder was sealed and the contents allowed to warm to room temperature with gentle shaking. The contents of the sample cylinder were pushed into the Parr reactor under nitrogen pressure, and polymerization was continued for 22 hours. At this time, the sample cylinder was charged with additional amount of styrene, 20.0 milliliters (18.2 grams), containing azoisobutyronitrile, 1.00 gram. The contents of the sample cylinder were pushed into the Parr reactor under nitrogen pressure, and polymerization was continued for an additional 20 hours. The temperature was then increased to 80° for an additional 22 hours. When the reaction was completed, the particles were isolated. Freeze drying afforded the above copolymer product, 115.4 grams, in 91 percent yield.

EXAMPLE VIII

Magenta colored toner particles of volume average diameter of 4 microns and a GSD of 1.05 were prepared from the copolymer resin obtained from the process of Example IV as follows:

A sample of the styrene butadiene copolymer product particles of Example IV, 9.0 grams, was placed in a 150 milliliter reaction bottle, together with 0.50 grams of Fanal Pink D, and 50 milliliters of a solution consisting of 5 percent poly(vinyl pyrrolidone) in methanol. The bottle was sealed and shaken for three hours at room temperature during which time the pigment migrated into the particles. The magenta toner composition was isolated by washing three times with water, 100 milliliters, followed by freeze drying.

EXAMPLE IX

Blue toner particles of volume average diameter of 4 microns and a GSD of 1.05 were prepared from the copolymer resin obtained from the process of Example IV as follows:

A sample of the particles, 9.0 grams, of the product of Example IV was placed in a 150 milliliter reaction bottle, together with 0.50 gram of Waxoline Blue APFW, and 50 milliliters of a solution consisting of 5 percent poly(vinyl pyrrolidone) in methanol. The bottle was sealed and shaken for three hours at room temperature, during which time the pigment migrated into the particles. The blue toner was isolated by washing three times with water, 100 milliliters, followed by freeze drying.

EXAMPLE X

Yellow toner particles of volume average diameter of 4 microns, and a GSD of 1.06 were prepared from the copolymer resin obtained from the process of Example IV as follows:

A sample of the copolymer product particles, 9.0 grams, was placed in a 150 milliliter reaction bottle, together with 0.50 gram of Permanent Yellow FGL, and 50 milliliters of a solution consisting of 5 percent poly(vinyl pyrrolidone) in methanol. The bottle was sealed and shaken for three hours at room temperature, during which time the pigment migrated into the particles. The yellow toner was isolated by repeating the process of Example IX Triboelectric values for the above prepared toners, and the particles of Example IV were measured against an uncoated ferrite (3 parts of toner to 100 parts of carrier) carrier by the known Faraday Cage method with the following results:

| EXAMPLE | COLORANT | TRIBOELECTRIC CHARGE (1) |
|---|---|---|
| IV | None | 32 |
| VIII | Fanal Pink D | 26 |
| IX | Waxoline Blue APFW | 23 |
| X | Permanent Yellow FGL | 26 |

(1) Positive triboelectric charge in microcoulombs per gram.

EXAMPLE XI

There can be prepared by melt blending, followed by mechanical attrition, a toner composition comprised of 80 percent by weight of the styrene butadiene copolymer resin of Example I, 3 percent by weight of Regal 330® carbon black, 16 percent by weight of Mapico Black, and 1 percent by weight of the charge enhancing additive distearyl dimethyl ammonium methyl sulfate. Subsequently, there can be prepared a developer composition by admixing the aforementioned formulated toner composition at a 4.5 percent toner concentration, that is 4.5 parts by weight of toner per 100 parts by weight of carrier, which carrier can be comprised of a steel core with a coating thereover of a vinyl chloride trichlorofluoroethylene copolymer with carbon black particles dispersed therein.

Thereafter, the formulated developer composition can be incorporated into an electrostatographic imaging device with a toner transporting means, a toner metering charging means, and a development zone as illustrated in U.S. Pat. No. 4,394,429, the disclosure of which is totally incorporated herein by reference; and wherein the imaging member is comprised of an aluminum supporting substrate, a photogenerating layer of trigonal selenium, and a charge transport layer thereover of the aryl amine N,N'-diphenyl-N,N'-bis(3-methylphenyl) 1,1'-biphenyl-4,4'-diamine, 50 percent by weight, dispersed in 50 percent by weight of the polycarbonate resin available as Makrolon, reference U.S. Pat. No. 4,265,990, the disclosure of which is totally incorporated herein by reference.

It is believed that there can be obtained in the aforementioned imaging fixture images of acceptable quality with no background deposits for about 75,000 developed images.

Other modifications of the present invention may occur to those skilled in the art subsequent to a review of the present application. The aforementioned modifications, including equivalents thereof, are intended to be included within the scope of the present invention.

What is claimed is:

1. A toner composition consisting essentially of styrene butadiene polymers prepared by dispersion polymerization process and wherein the process comprises providing a homogeneous organic phase comprising at least one solvent, at least one steric stabilizer selected from consisting of poly(12-hydroxystearic acid), poly(isobutylene), poly(isoprene), poly(2-ethylhexylmethacrylate) and copolymers thereof or from the group consisting of hydroxypropylcellulose, methyl cellulose, poly(vinyl pyrrolidone), poly(vinyl butyral), poly(ethylene oxide), poly(acrylic acids), and poly(vinyl pyridine) has been added after the expression "steric stabilizer", a chain propagating amount of at least one initiator, styrene monomer, butadiene monomer, and a vapor phase comprising an inert gas and butadiene monomer; heating the organic phase and the vapor phase to a temperature of from about 40° to about 130° C. at a pressure of from about 20 to about 2,000 pounds per square inch thereby permitting polymerization; cooling the resulting mixture and separating therefrom the styrene butadiene polymer product; and pigment particles, which toner composition has an average particle diameter of from about 1 to about 15 microns, a narrow size particle distribution with a geometric standard deviation of from about 1 to about 1.4 microns and wherein said styrene butadiene polymer has a molecular weight dispersibility of from about 5 to about 120, wherein the weight average molecular weight of said styrene butadiene is from about 10,000 to about 500,000, and wherein jetting is avoided in forming the toner composition.

2. A toner composition in accordance with claim 1 wherein the pigment particles are carbon black.

3. A toner composition in accordance with claim 1 wherein the pigment particles are magnetite.

4. A toner composition in accordance with claim 1 wherein the pigment particles are comprised of a mixture of carbon black and magnetites.

5. A toner composition in accordance with claim 1 wherein the pigment particles are selected from the group consisting of magenta, cyan, yellow, and mixtures thereof.

6. A toner composition in accordance with claim 1 containing a charge enhancing additive selected from the group consisting of distearyl dimethyl ammonium methyl sulfate, cetyl pyridinium halides, and stearyl phenethyl dimethyl ammonium tosylate.

7. A toner composition in accordance with claim 6 wherein the charge enhancing additive is distearyl dimethyl ammonium methyl sulfate.

8. A toner composition in accordance with claim 7 wherein the pigment particles are selected from the group consisting of magenta, cyan, yellow and mixtures thereof.

9. A toner composition in accordance with claim 7 wherein the resin particles are comprised of a styrene butadiene copolymer containing 91 percent by weight of styrene and 9 percent by weight of a butadiene, or 87 percent by weight of styrene and 13 percent by weight of butadiene.

10. A toner composition in accordance with claim 6 wherein the pigment particles are comprised of a mixture of carbon black and magnetite.

11. A toner composition in accordance with claim 10 wherein the mixture contains from about 6 percent by weight to about 70 percent by weight of magnetite, and from about 2 percent by weight to about 15 percent by weight of carbon black.

12. A toner composition in accordance with claim 1 with a GSD of from about 1 to about 1.1 wherein the average particle diameter of the toner is from about 3 to about 10 microns.

13. A toner in accordance with claim 1 wherein the toner particles are of an average diameter of from about 3 to about 10 microns.

14. A toner composition consisting essentially of styrene butadiene particle polymers prepared by a dispersion polymerization process consisting essentially of polymerizing a homogeneous organic or aqueous/organic mixture comprising one or more solvents, one or more steric stabilizers selected from consisting of poly(12-hydroxystearic acid), poly(isobutylene), poly(isoprene), poly(2-ethylhexylmethacrylate) and copolymers thereof or from the group consisting of hydroxypropylcellulose, methyl cellulose, poly(vinyl pyrrolidone), poly(vinyl butyral), poly(ethylene oxide), poly(acrylic acids), and poly(vinyl pyridine) a chain propagating amount of one or more initiators, styrene monomer, butadiene monomer, and a surfactant; the ratio of the styrene monomer and butadiene monomer being between about 70:30 and about 95:5 by weight, the weight proportion of the combination of styrene monomer and butadiene monomer to solvent being present between about 0.05:1 to about 1.2:1, the weight proportion of the initiators to the combination of the styrene and butadiene monomers present being between about 0.1 percent to 7 percent, the amount of surfactant being between about 0.01 percent and 20 percent by weight and a vapor phase comprising an inert gas and butadiene monomer; heating the organic phase and the vapor phase to a temperature between about 40° C. and about 130° C. at a pressure between about 20 psi and about 2,000 psi for a period of between about 6 and about 70 hours; and pigment particles, which toner composition has an average particle diameter of from between about 1 to about 15 microns, and wherein jetting is avoided in forming the toner composition.

* * * * *